US008625825B2

(12) United States Patent
Lee

(10) Patent No.: US 8,625,825 B2
(45) Date of Patent: Jan. 7, 2014

(54) ELECTROSTATIC SPEAKER

(75) Inventor: Han-Ryang Lee, Gyeonggi-do (KR)

(73) Assignee: BSE Co., Ltd., Incheon (KR)

( * ) Notice: Subject to any disclaimer, the term of this patent is extended or adjusted under 35 U.S.C. 154(b) by 22 days.

(21) Appl. No.: 13/144,590

(22) PCT Filed: Feb. 11, 2010

(86) PCT No.: PCT/KR2010/000882
§ 371 (c)(1),
(2), (4) Date: Jul. 14, 2011

(87) PCT Pub. No.: WO2011/059144
PCT Pub. Date: May 19, 2011

(65) Prior Publication Data

US 2011/0268297 A1 Nov. 3, 2011

(30) Foreign Application Priority Data

Nov. 10, 2009 (KR) ..... 10-2009-0108330

(51) Int. Cl.
*H04R 25/00* (2006.01)

(52) U.S. Cl.
USPC ..... 381/191; 381/396; 381/423

(58) Field of Classification Search
USPC ..... 381/191, 111, 116, 190, 173–176, 396, 381/398, 423–429
See application file for complete search history.

(56) References Cited

U.S. PATENT DOCUMENTS 3,705,312 A * 12/1972 Sessler et al. ..... 307/400
3,942,029 A * 3/1976 Kawakami et al. ..... 307/400
3,985,201 A * 10/1976 Kloster ..... 181/163
5,062,140 A * 10/1991 Inanaga et al. ..... 381/399
6,999,596 B2 * 2/2006 Hiramoto et al. ..... 381/369
2002/0141606 A1 * 10/2002 Schweder et al. ..... 381/116
2005/0281419 A1 * 12/2005 Miyazaki et al. ..... 381/191
2007/0189559 A1 * 8/2007 Haan et al. ..... 381/191
2007/0274545 A1 * 11/2007 Nakaya et al. ..... 381/191
2010/0032788 A1 * 2/2010 Ulbrich ..... 257/464

FOREIGN PATENT DOCUMENTS

JP 2002-204495 A 7/2002
JP 2007-043523 A 2/2007
JP 2008-028736 A 2/2008
JP 2009-017337 A * 1/2009 ..... H04R 19/02
JP 2009-117888 A * 5/2009 ..... H04R 19/02

OTHER PUBLICATIONS

International Search Report: mailed Dec. 8, 2010; PCT/KR2010/000882.

* cited by examiner

*Primary Examiner* — Suhan Ni
(74) *Attorney, Agent, or Firm* — Ladas & Parry LLP

(57) ABSTRACT

An electrostatic speaker including a frame; a first electrode installed at a first end of the frame; a second electrode installed at a second end of the frame to be at a predetermined distance apart from the first electrode; a suspension which is arranged between the second electrode and the first electrode and is elastically installed inside the frame; and a diaphragm assembly which is supported by the suspension and has a multilayer structure. The electrostatic speaker adopts a dual electrode structure, has the multilayer structure formed inside the diaphragm assembly, and is provided with a driving chip that applies a bias voltage to the diaphragm assembly by rectifying an audio signal after applying a driving signal that has amplified the audio signal to the dual electrodes. Thus, the invention does not require any external power, and is also capable of maintaining relatively high sensitivity by enhancing the charge density.

7 Claims, 10 Drawing Sheets

ELECTROSTATIC SPEAKER

TECHNICAL FIELD

The present invention relates to a speaker, and more particularly, to an electrostatic speaker having a dual electrodes structure, in which a multilayer structure is formed inside a diaphragm assembly, a driving signal, which is generated by amplifying an audio signal, is applied to dual electrodes, the audio signal is rectified, and a bias voltage is applied to the diaphragm assembly.

BACKGROUND ART

Generally, when a call signal is received from another person, a mobile communication device outputs via a speaker a ring tone or a melody to notify the user of the reception of the call signal.

Furthermore, as various functions, e.g., MP3 playback, digital multimedia broadcasting (DMB) service, games, etc., are embedded in mobile communication devices, the performance of speakers of mobile communication devices has become very important.

A speaker is a device for converting electric energy to mechanical energy by using a voice coil placed within a gap. The conversion takes place according to the Fleming's left hand rule, which states that, if a conductor via which a current is flowing is in a magnetic field, a force is applied to the conductor. In other words, a current signal of various frequencies is applied to a voice coil, the voice coil generates mechanical energy according to the intensity and frequency of the current and makes a diaphragm attached to the voice coil oscillate, and thus, a sound pressure of a predetermined magnitude audible to the human ear is generated. A device which generates a relatively low sound pressure and is used close to the human ear is generally referred to as a receiver, whereas a device which generates a relatively high sound pressure and is used a predetermined distance away from the human ear is referred to as a speaker.

Speakers may be categorized according to their structures into, for example, a cone type, a flat-panel type in which a voice coil is directly attached to a diaphragm, a dome type which uniformly spreads reproduced sound, a hone type which is for a megaphone and has high directivity, a ribbon type which precisely reproduces sound characteristics, an electrostatic type (condenser type) which outputs fine sound and has a relatively small size, etc. Furthermore, according to sound quality, speakers may be categorized into a woofer, a tweeter, and a mid-range unit.

An electrostatic speaker includes an audio signal electrode plate and a diaphragm. A high voltage is applied to the diaphragm, which is formed of a material with high surface resistance, and thus, the diaphragm can store positive or negative charges. An electrostatic attraction takes place between positive and negative charges between a stator, which is an audio signal electrode, and the diaphragm. An audio signal electrode plate, which is continuously changed according to audio signals, pushes the diaphragm at one side and pulls the diaphragm at another side, and thus, the diaphragm oscillates. The oscillation is reproduced as sound. An audio signal is converted into high pressure by an audio transformer, which is then applied to an audio signal electrode plate. The closer a distance between the audio signal electrode and the diaphragm is or the larger a voltage difference is, a greater force is generated, but there is a restriction. The restriction is a natural discharging phenomenon due to a high voltage difference. Therefore, it is impossible to infinitely increase a voltage difference or to arrange the audio signal electrode and the diaphragm too close to each other. Furthermore, it is necessary to consider a sufficient distance between the audio signal electrode and the diaphragm to reproduce the entire audible frequency band.

In a conventional electrostatic speaker, a single electrode plate is arranged, and a diaphragm has a single structure. Therefore, the conventional electrostatic speaker has relatively low sensitivity and low charging density. Furthermore, since a separate external power supply for a diaphragm is required, there are limits in designing an electrostatic speaker.

DISCLOSURE OF THE INVENTION

Technical Problem

The present invention provides an electrostatic speaker which adopts a dual electrode structure, has the multilayer structure formed inside a diaphragm assembly, and is provided with a driving chip that applies a bias voltage to the diaphragm assembly by rectifying an audio signal after applying a driving signal that has amplified the audio signal to the dual electrodes, where the electrostatic speaker does not require any external power and is also capable of maintaining relatively high sensitivity by enhancing the charge density.

Technical Solution

According to an aspect of the present invention, there is provided an electrostatic speaker including a frame; a first electrode installed at a first end of the frame; a second electrode installed at a second end of the frame to be at a predetermined distance apart from the first electrode; a suspension which is arranged between the second electrode and the first electrode and is elastically installed inside the frame; and a diaphragm assembly which is supported by the suspension and has a multilayer structure.

In the diaphragm assembly, a conductive layer is formed, insulation layers are formed on both surfaces of the conductive layer, and charging diaphragms are respectively formed on surfaces of the insulation layers.

The second electrode may form a cover-integrated structure by being attached to is the frame.

The electrostatic speaker further includes a driving chip for applying a driving signal generated by amplifying an audio signal to the first electrode and the second electrode, rectifying the audio signal, and applying a bias voltage to the diaphragm assembly.

The driving chip includes an interface unit for receiving inputs of analog or digital audio signals; a signal processing unit for processing signals input via the interface unit; an amplifying unit for driving the first electrode and the second electrode by amplifying the processed audio signal; a rectifying unit for rectifying the audio signal output by the amplifying unit and applying the rectified audio signal to the diaphragm assembly; and a stabilizing unit for detecting a voltage applied to the diaphragm assembly and stabilizing the voltage.

Advantageous Effects

As described above, according to embodiments of the present invention, a dual electrodes structure is employed, a multilayer structure is formed inside a diaphragm assembly, and a driving chip for applying a driving signal generated by amplifying an audio signal to dual electrodes, rectifying the audio signal, and applying a bias voltage to the diaphragm assembly is employed. As a result, no external power supply is needed, and a relatively high sensitivity may be maintained due to an increased charging density.

BEST MODE FOR CARRYING OUT THE INVENTION

The present invention will now be described more fully with reference to the accompanying drawings, in which exemplary embodiments of the invention are shown.

FIG. 1 is an exploded perspective view of an electrostatic speaker according to an embodiment of the present invention. FIG. 2 is a combined perspective view of an electrostatic speaker according to an embodiment of the present invention. FIG. 3 is a plan view of an electrostatic speaker according to an embodiment of the present invention. FIG. 4 is a lateral view of the electrostatic speaker 100 shown in FIG. 2. FIG. 5 is a front view of the electrostatic speaker 100 shown in FIG. 2. FIG. 6 is a cross-sectional view of the electrostatic speaker 100 shown in FIG. 3, taken along a line I-I of FIG. 3. FIG. 7 is a cross-sectional view of the electrostatic speaker 100 shown in FIG. 3, taken along a line II-II. FIG. 8 is an exploded perspective view of a diaphragm assembly 150 according to an embodiment of the present invention. FIG. 9 is sectional view of the diaphragm assembly 150 according to an embodiment of the present invention. FIG. 10 is a block diagram of a driving chip 160 for driving the electrostatic speaker 100 according to an embodiment of the present invention. FIG. 11 is a diagram for describing an audio signal applied to a first electrode 120 and a second electrode 130 and a bias voltage which is generated by rectifying the audio signal and is applied to the diaphragm assembly 150, according to an embodiment of the present invention.

The following is a list identifying the reference numerals used in FIGS. 1-11:

100: electrostatic speaker
110: frame
120: first electrode
130: second electrode
140: suspension
150: second electrode
151: conductive layer
152: insulating layer
153: charging diaphragm
160: driving chip
161: interface unit
162: signal processing unit
163: amplifier
164: rectifying unit
165: stabilizing unit
166: voltage detecting unit As shown in FIGS. 1 through 11, the electrostatic speaker 100 according to an embodiment of the present invention includes a frame 110, the first electrode 120 which is arranged at a first end of the frame 110, the second electrode 130 which is arranged at a second end of the frame 110 to be at a predetermined distance apart from the first electrode 120, a suspension 140 which is arranged between the second electrode 130 and the first electrode 120 and is elastically arranged inside the frame 110, and the diaphragm assembly 150 which is supported by the suspension 140 and has a multilayer structure.

The diaphragm assembly 150 may have a multilayer structure including two layers, four layers, six layers, and so on. For example, as shown in FIGS. 8 and 9, in the diaphragm assembly 150, a conductive layer 151 may be formed, insulation layers 152 and 152' may be formed on both surfaces of the conductive layer 151, and the charging diaphragms 153 and 153' may be respectively formed on surfaces of the insulation layers 152 and 152'.

The second electrode 130 may form a cover-integrated structure by being attached to the frame 110.

As shown in FIGS. 10 and 11, the electrostatic speaker 100 according to the present embodiment further includes the driving chip 160 for applying a driving signal, which is generated by amplifying an audio signal, to the first electrode 120 and the second electrode 130, rectifying the audio signal, and applying a bias voltage to the diaphragm assembly 150.

The driving chip 160 includes an interface unit 161 for receiving analog or digital audio signals as inputs, a signal processing unit 162 for processing signals input via the interface unit 161, an amplifying unit 163 for amplifying processed audio signals and driving the first electrode 120 and the second electrode 130, a rectifying unit 164 for rectifying the audio signals output by the amplifying unit 163 and applying the rectified audio signal to the diaphragm assembly 150, and a stabilizing unit 165 for detecting a voltage applied to the diaphragm assembly 150 and stabilizing the voltage.

As described above, the driving chip 160 according to the present embodiment does not use an external bias voltage and applies a bias voltage to the diaphragm assembly 150 by using a voltage generated by rectifying audio signals.

In the electrostatic speaker 100 according to the present embodiment as described above, the driving chip 160 applies a driving signal generated by amplifying an audio signal to the first electrode 120 and the second electrode 130, rectifies the audio signal, and applies a high bias voltage to the conductive layer 151 of the diaphragm assembly 150.

Positive or negative charges are stored by the charging diaphragms 153 and 153' formed on surfaces of the diaphragm assembly 150, and electrostatic attraction between positive and negative charges takes place between the first electrode 120 and the second electrode 130, which are audio signal electrodes, and the diaphragm assembly 150. The audio signal electrodes, which are continuously changed according to audio signals, push the diaphragm assembly 150 at one side and pull the diaphragm assembly 150 at another side, and thus, the diaphragm assembly 150 oscillates. The oscillation is reproduced as sound.

Furthermore, the driving chip 160 according to the present embodiment may detect a voltage applied to the diaphragm assembly 150 by using a voltage detecting unit 166, stabilize the voltage by using the stabilizing unit 165, and transmits the stabilized voltage to the signal processing unit 162 as feedback.

As described above, according to embodiments of the present invention, a dual electrodes structure is employed, a multilayer structure is formed inside a diaphragm assembly, and a driving chip for applying a driving signal generated by amplifying an audio signal to dual electrodes, rectifying the audio signal, and applying a bias voltage to the diaphragm assembly is employed. As a result, no external power supply is needed, and a relatively high sensitivity may be maintained due to an increased charging density.

While the present invention has been particularly shown and described with reference to exemplary embodiments thereof, it will be understood by those of ordinary skill in the art that various changes in form and details may be made therein without departing from the spirit and scope of the present invention as defined by the following claims.

Figure 1:
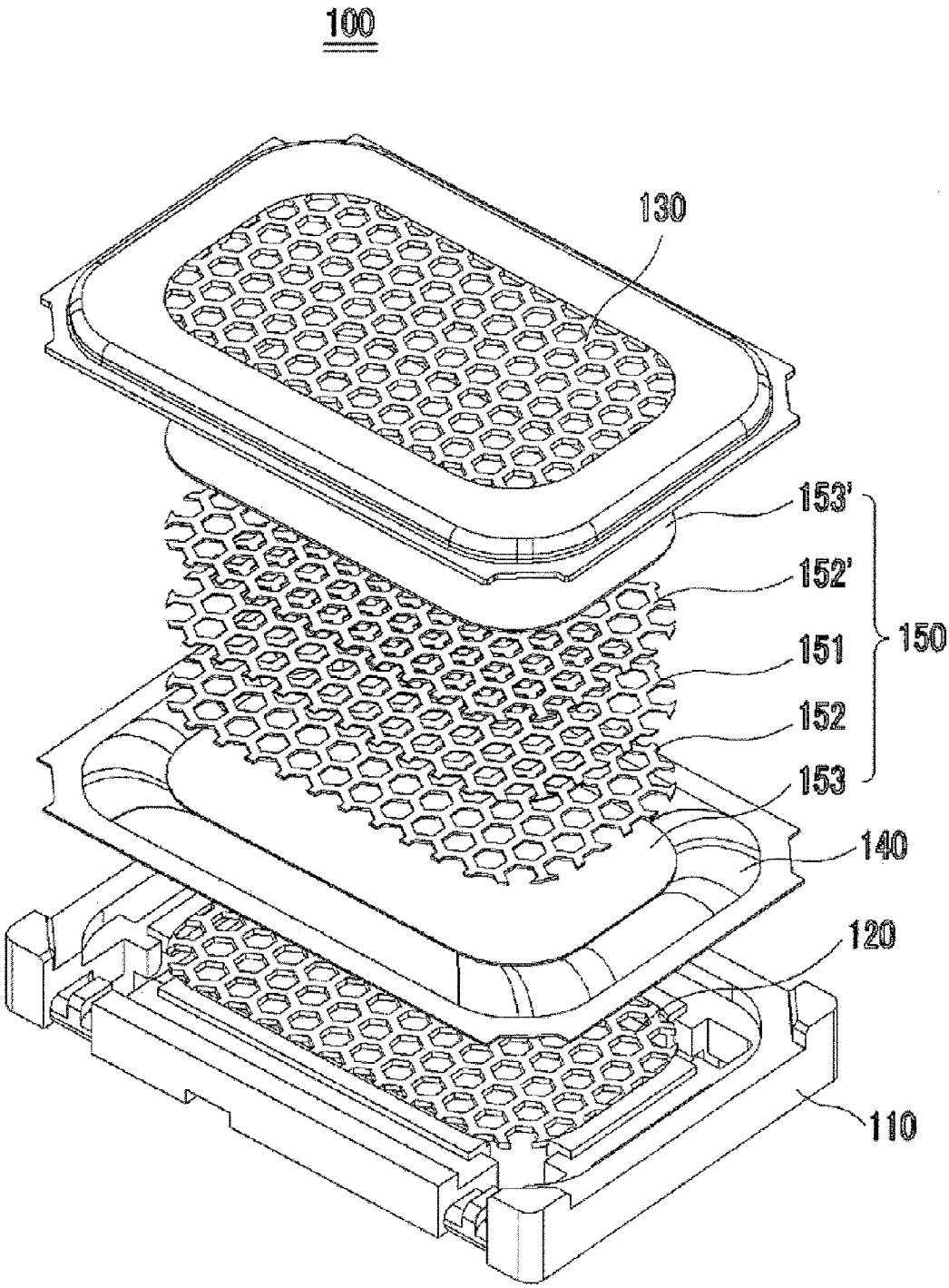
FIG. 1 is an exploded perspective view of an electrostatic speaker according to an embodiment of the present invention.
Figure 2:
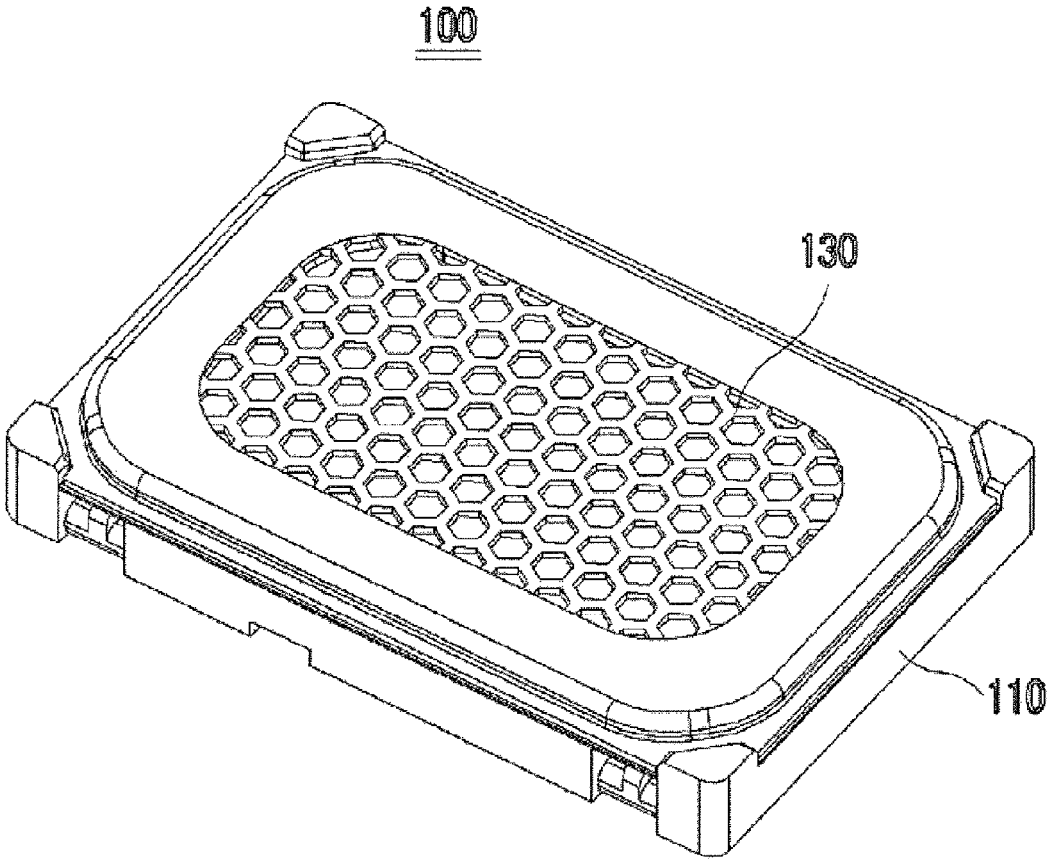
FIG. 2 is a combined perspective view of an electrostatic speaker according to an embodiment of the present invention.
Figure 3:
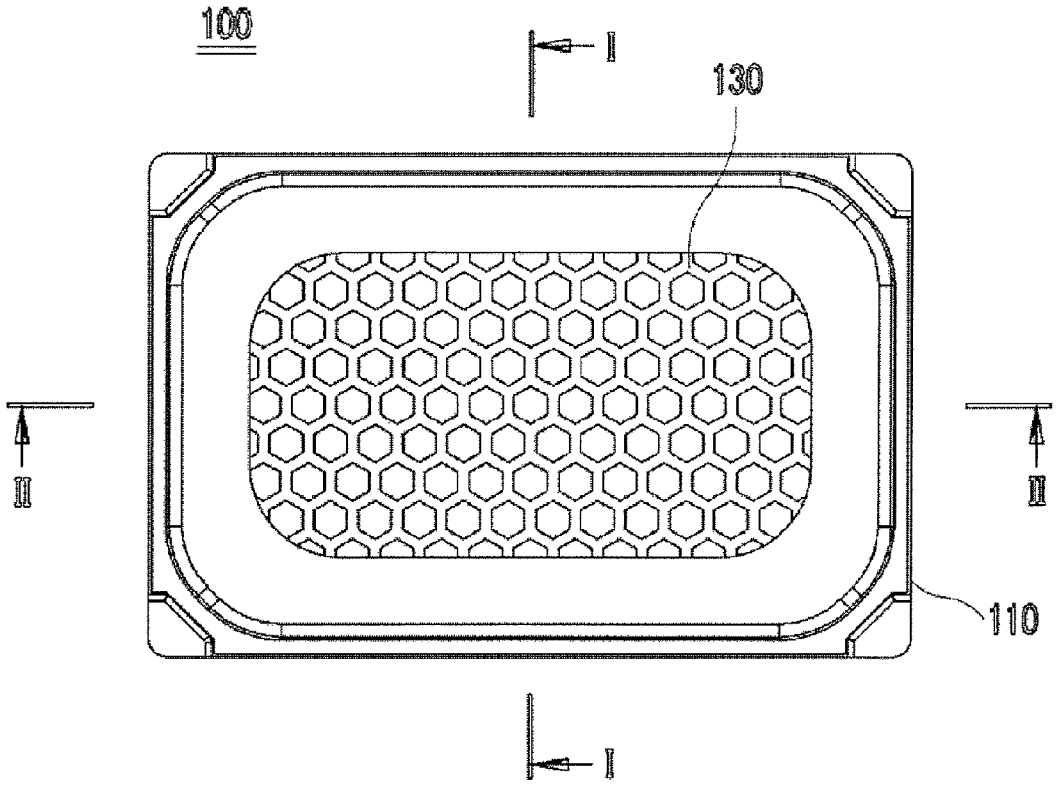
FIG. 3 is a plan view of an electrostatic speaker according to an embodiment of the present invention.
Figure 4:
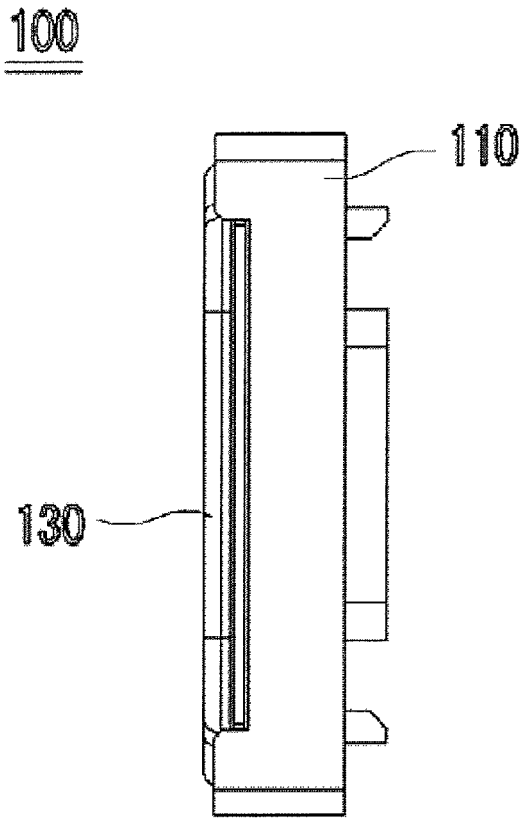
FIG. 4 is a lateral view of the electrostatic speaker shown in FIG. 2.
Figure 5:
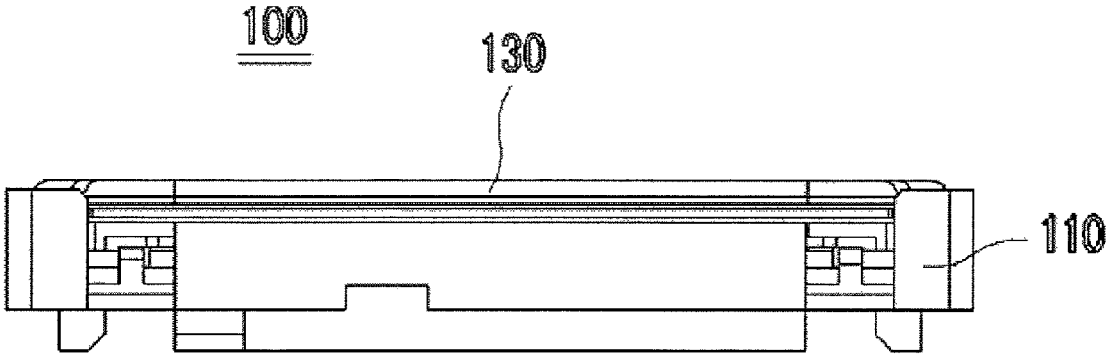
FIG. 5 is a front view of the electrostatic speaker shown in FIG. 2.
Figure 6:
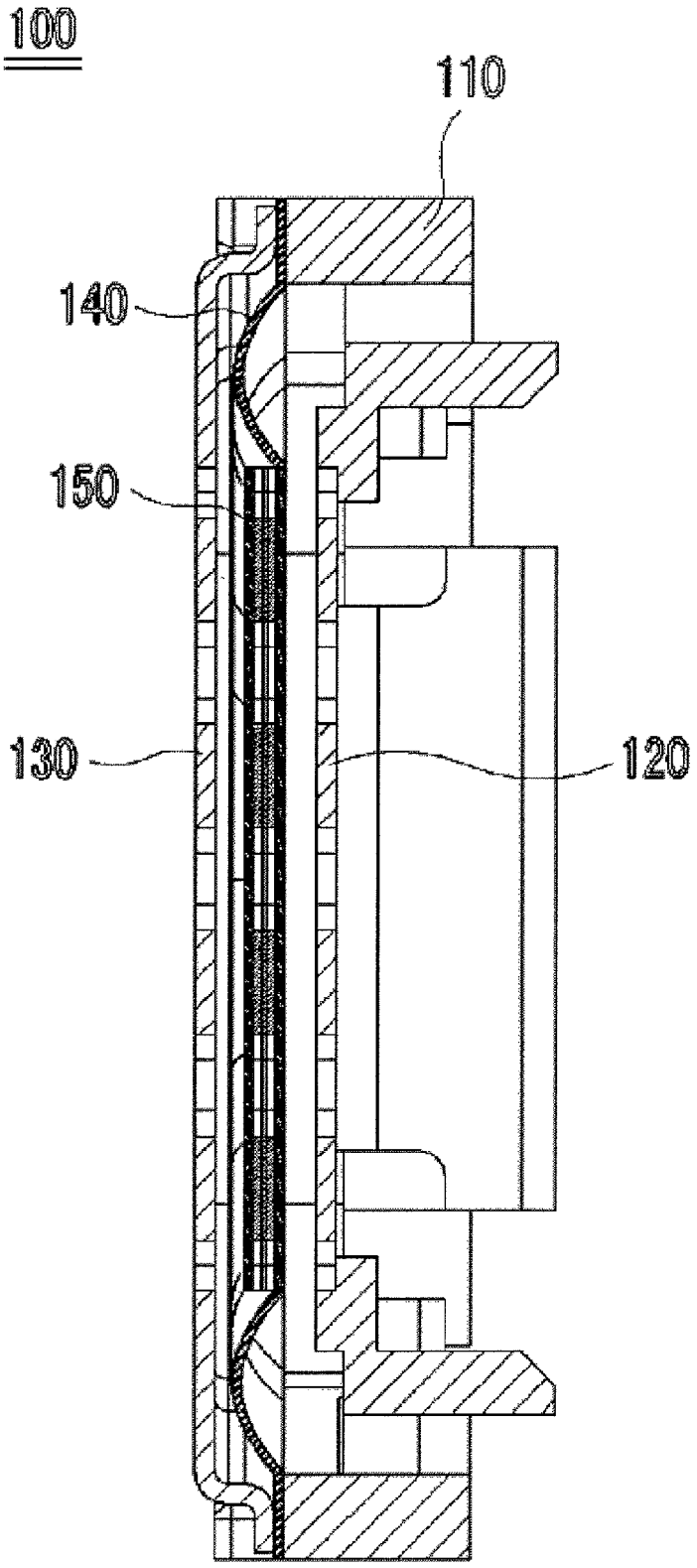
FIG. 6 is a cross-sectional view of the electrostatic speaker shown in FIG. 3, taken along a line I-I of FIG. 3.
Figure 7:
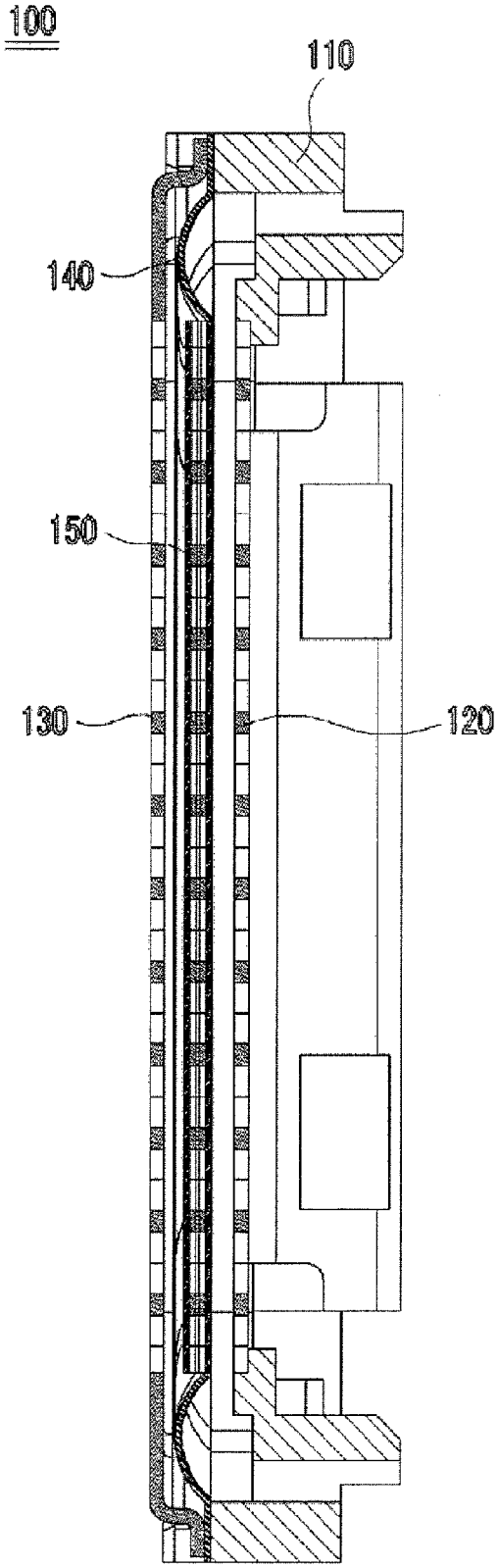
FIG. 7 is a cross-sectional view of the electrostatic speaker shown in FIG. 3, taken along a line II-II.
Figure 8:
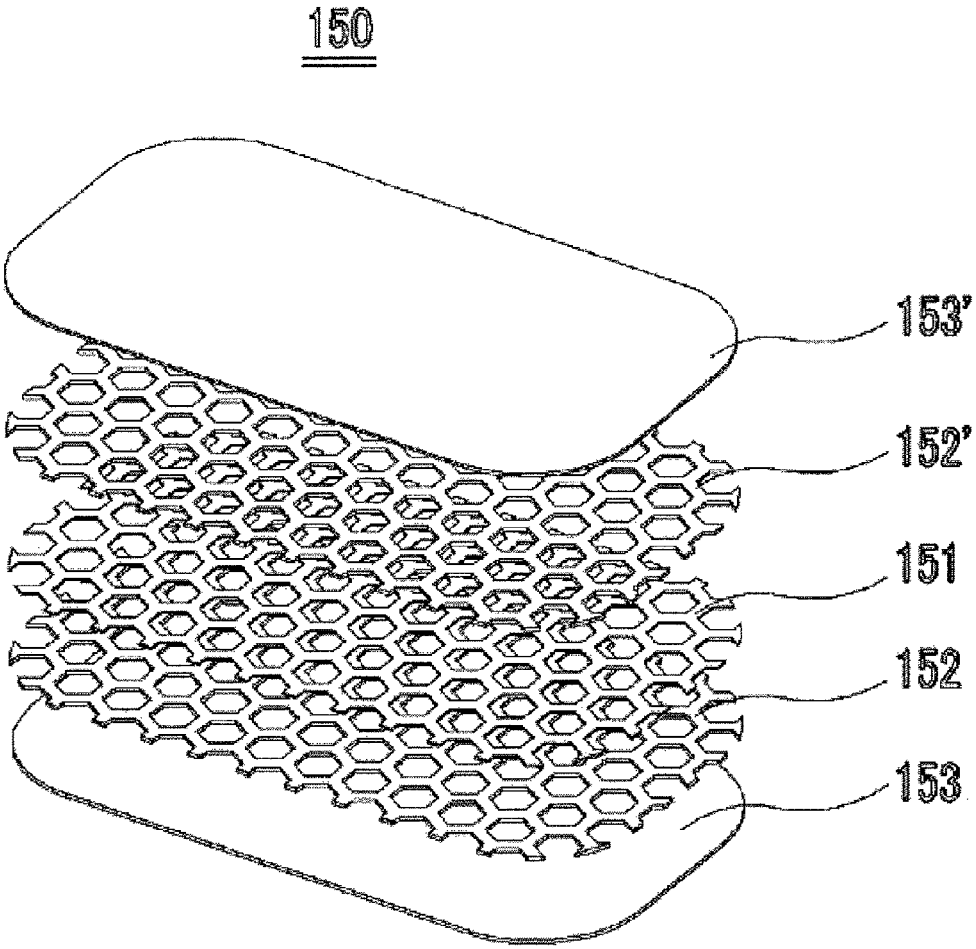
FIG. 8 is an exploded perspective view of a diaphragm assembly according to an embodiment of the present invention.
Figure 9:
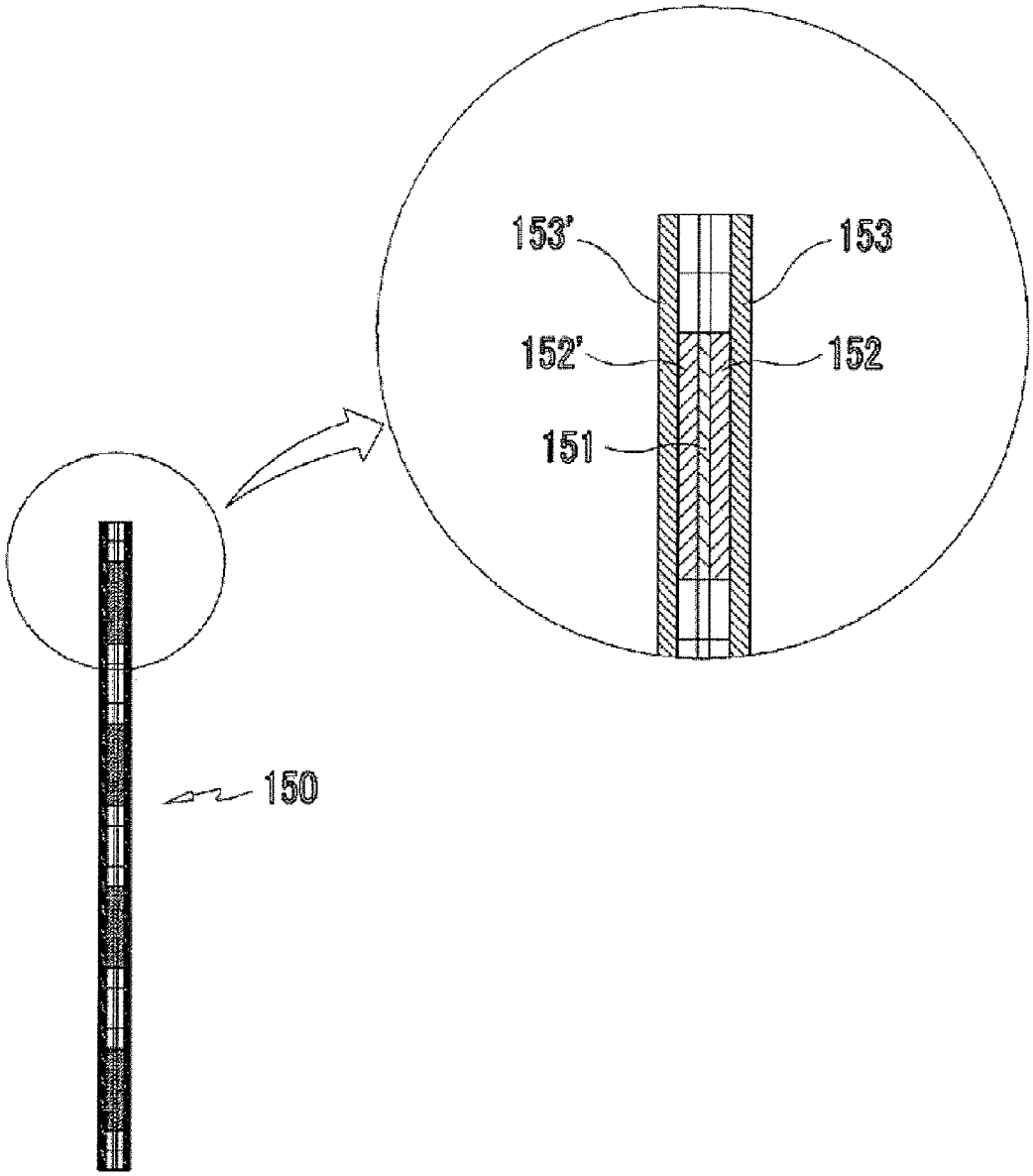
FIG. 9 is sectional view of a diaphragm assembly according to an embodiment of the present invention.
Figure 10:
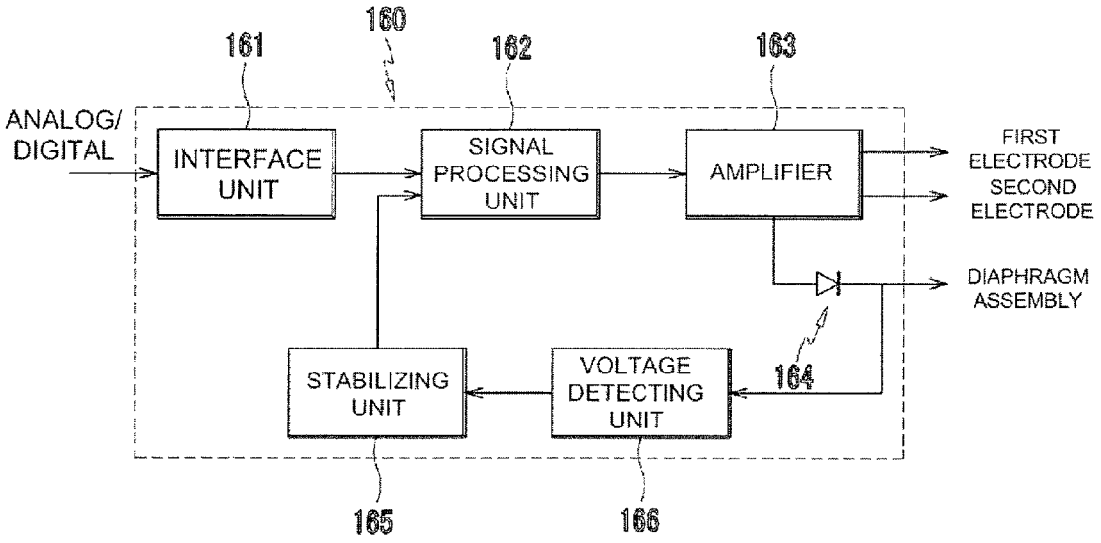
FIG. 10 is a block diagram of a driving chip for driving an electrostatic speaker according to an embodiment of the present invention.
Figure 11:
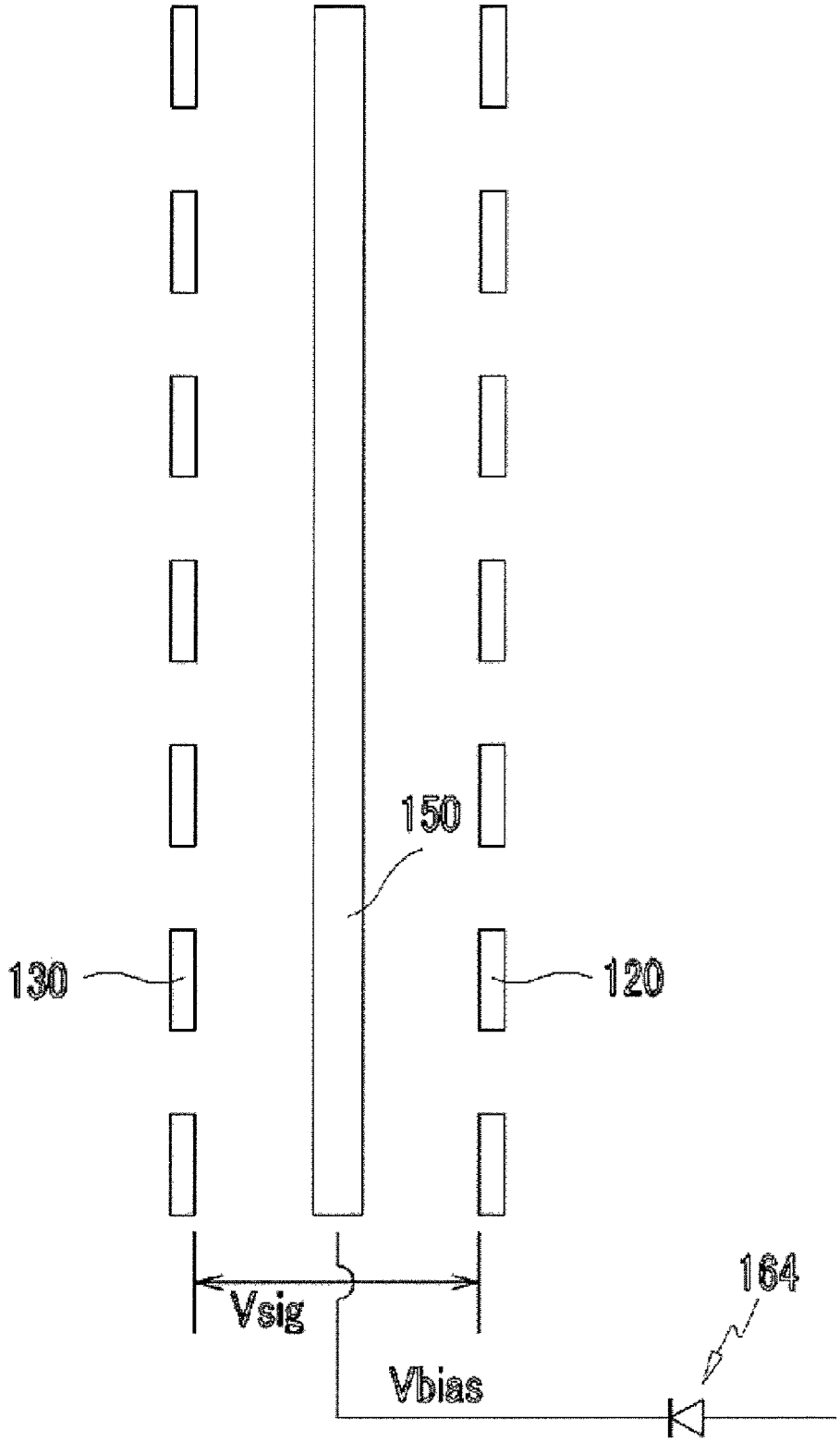
FIG. 11 is a diagram for describing an audio signal applied to a first electrode and a second electrode and a bias voltage which is generated by rectifying the audio signal and is applied to a diaphragm assembly, according to an embodiment of the present invention.

The invention claimed is:

1. An electrostatic speaker comprising:

a frame;

a first electrode installed at a first end of the frame;

a second electrode installed at a second end of the frame to be at a predetermined distance apart from the first electrode;

a suspension which is arranged between the second electrode and the first electrode and is elastically installed inside the frame; and a diaphragm assembly which is supported by the suspension and has a multilayer structure wherein, in the diaphragm assembly, a conductive layer is formed, insulation layers are formed on both surfaces of the conductive layer, and charging diaphragms are respectively formed on surfaces of the insulation layers.

2. The electrostatic speaker of claim 1, wherein the second electrode forms a cover-integrated structure by being attached to the frame.

3. The electrostatic speaker of claim 1, further comprising a driving chip for applying a driving signal generated by amplifying an audio signal to the first electrode and the second electrode, rectifying the audio signal, and applying a bias voltage to the diaphragm assembly.

4. The electrostatic speaker of claim 3, wherein the driving chip comprises:

an interface unit for receiving inputs of analog or digital audio signals;

a signal processing unit for processing signals input via the interface unit;

an amplifying unit for driving the first electrode and the second electrode by amplifying the processed audio signal;

a rectifying unit for rectifying the audio signal output by the amplifying unit and applying the rectified audio signal to the diaphragm assembly; and a stabilizing unit for detecting a voltage applied to the diaphragm assembly and stabilizing the voltage.

5. An electrostatic speaker comprising:

a first electrode installed at a first end of a frame;

a second electrode installed at a second end of the frame to be at a predetermined distance apart from the first electrode;

a suspension which is arranged between the second electrode and the first electrode and is elastically installed inside the frame;

a diaphragm assembly which is supported by the suspension and has a multilayer structure; and a driving chip for applying a driving signal generated by amplifying an audio signal to the first electrode and the second electrode, rectifying the audio signal, and applying a bias voltage to the diaphragm assembly, wherein the driving chip comprises:

an interface unit for receiving analog or digital audio signals as inputs;

a signal processing unit for processing signals input via the interface unit;

an amplifying unit for driving the first electrode and the second electrode by amplifying the processed audio signal;

a rectifying unit for rectifying the audio signal output by the amplifying unit and applying the rectified audio signal to the diaphragm assembly; and a stabilizing unit for detecting a voltage applied to the diaphragm assembly and stabilizing the voltage.

6. An electrostatic speaker comprising:

a frame;

a first electrode installed at a first end of the frame;

a second electrode installed at a second end of the frame to be at a predetermined distance apart from the first electrode, the first and second electrodes being configured to receive an amplified audio signal;

a suspension which is arranged between the second electrode and the first electrode and is elastically installed inside the frame; and a diaphragm assembly which is supported by the suspension and has a multilayer structure that oscillates according to the amplified audio signal, the diaphragm assembly comprising:

a conductive layer configured to receive a bias voltage, first and second insulation layers formed on both surfaces of the conductive layer, and first and second charging diaphragms for storing positive or negative charges, the first charging diaphragm formed on a surface of the first insulation layer such that the first insulation layer is interposed between the conductive layer and the first charging diaphragm, and the second charging diaphragm formed on a surface of the second insulation layer such that the second insulation layer is interposed between the conductive layer and the second charging diaphragm.

7. The electrostatic speaker of claim 6, wherein the driving chip comprises:

an interface unit for receiving inputs of analog or digital audio signals;

a signal processing unit for processing signals input via the interface unit;

an amplifying unit for driving the first electrode and the second electrode by amplifying the processed audio signal;

a rectifying unit for rectifying the audio signal output by the amplifying unit and applying the rectified audio signal to the conductive layer of the diaphragm assembly as a bias voltage; and a stabilizing unit for detecting a voltage applied to the diaphragm assembly and stabilizing the voltage.

* * * * *